US009933717B2

(12) United States Patent
Fujisaki et al.

(10) Patent No.: US 9,933,717 B2
(45) Date of Patent: Apr. 3, 2018

(54) TONER FOR ELECTROSTATIC CHARGE IMAGE DEVELOPMENT AND IMAGE FORMING METHOD

(71) Applicant: Konica Minolta, Inc., Tokyo (JP)

(72) Inventors: Tatsuya Fujisaki, Hino (JP); Noboru Ueda, Mitaka (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/444,465

(22) Filed: Feb. 28, 2017

(65) Prior Publication Data

US 2017/0285502 A1 Oct. 5, 2017

(30) Foreign Application Priority Data

Mar. 30, 2016 (JP) ..... 2016-068128

(51) Int. Cl.

| | |
|---|---|
| ***G03G 9/08*** | (2006.01) |
| ***G03G 9/087*** | (2006.01) |
| ***G03G 9/09*** | (2006.01) |
| ***G03G 15/08*** | (2006.01) |

(52) U.S. Cl.

CPC ..... *G03G 9/08711* (2013.01); *G03G 9/0821* (2013.01); *G03G 9/08755* (2013.01); *G03G 9/091* (2013.01); *G03G 9/092* (2013.01); *G03G 9/0904* (2013.01); *G03G 9/0918* (2013.01); *G03G 15/08* (2013.01)

(58) Field of Classification Search

CPC ..... G03G 9/08711; G03G 9/08755; G03G 9/0821

USPC ..... 430/109.3, 111.4, 109.4

See application file for complete search history.

(56) References Cited

U.S. PATENT DOCUMENTS 6,316,157 B1 * 11/2001 Yoshikawa ..... G03G 9/0821 430/108.3

FOREIGN PATENT DOCUMENTS

| | | |
|---|---|---|
| JP | 2002311635 A | 10/2002 |
| JP | 2004078206 A | 3/2004 |
| JP | 2010085942 A | 4/2010 |

* cited by examiner

*Primary Examiner* — Mark A Chapman

(74) *Attorney, Agent, or Firm* — Lucas & Mercanti, LLP

(57) ABSTRACT

The present invention relates to a toner for electrostatic charge image development, including: a toner base particle having at least a binder resin, a releasing agent, and a colorant, wherein the following formula (1) is satisfied wherein a maximum value and a minimum value of a dielectric loss tangent tan δ, which are obtained by measuring at a frequency in the range of 1 kHz to 100 kHz under the condition at a temperature of 20° C. and a relative humidity of 50% RH, are defined as tan $\delta_{max}$ and tan $\delta_{min}$, respectively. According to the present invention, a toner for electrostatic charge image development, with which the rising of the toner charge amount is improved while ensuring the low temperature fixability, and a high quality image having less density unevenness can be obtained even during the image forming at a high speed and a high printing rate, is provided.

$$\text{Frequency showing } \tan\delta_{max} < \text{Frequency showing } \tan\delta_{min} \quad (1)$$

8 Claims, 1 Drawing Sheet

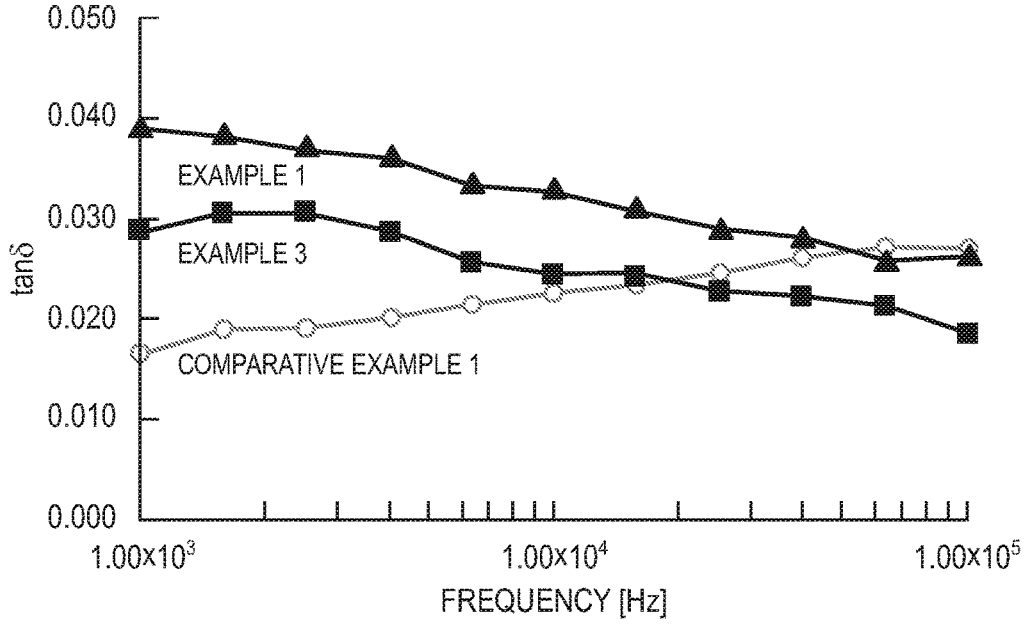
0.050
0.040
0.030
0.020
0.010
0.000
tanδ
EXAMPLE 1
EXAMPLE 3
COMPARATIVE EXAMPLE 1
1.00x10^3
1.00x10^4
1.00x10^5
FREQUENCY [Hz]

TONER FOR ELECTROSTATIC CHARGE IMAGE DEVELOPMENT AND IMAGE FORMING METHOD

CROSS-REFERENCE TO RELATED APPLICATION

This application is based on Japanese Patent Application No. 2016-068128 filed on Mar. 30, 2016, the contents of which are incorporated herein by reference.

BACKGROUND

1. Technical Field

The present invention relates to a toner for electrostatic charge image development, and an image forming method.

2. Description of Related Art

In recent years, as to an electrophotographic image forming apparatus, the application has expanded from the use as an ordinary copying machine or a printer, which is used for printing or mere copying of documents in offices, to the extent of the use in the field of creation of printed matters outside the offices. Specifically, the application has expanded to the extent of an on-demand printing (POD) market that is in the field of light printing because variable information from electronic data can be easily printed.

As a result of the expansion to the field of light printing, there has been an increasing demand for ensuring the wider color reproduction area in the market. As a color toner to form such a color image, a yellow toner, a magenta toner, a cyan toner, a black toner, and the like, each of which contains a binder resin (binder resin) formed by a thermoplastic resin and a colorant of each color, are used.

In a commercial printing area, the image output at a high printing rate is the mainstream, and the further speeding-up is required in order to improve the productivity. For the color toner, also from the viewpoint of energy saving, low temperature fixability is required.

As a technique in order to solve the problem described above, for example, in JP 2004-078206 A, JP 2002-311635 A, and JP 2010-085942 A, a technique in which in a toner at least containing toner base particles containing a binder resin and carbon black and inorganic fine powder, the particle size distribution, dielectric loss tangent tan δ, acid value, average circularity, or the like of the toner base particles is set in the predetermined range has been disclosed.

SUMMARY

In the case where images are formed at a high speed and a high printing rate, a large amount of a toner is consumed and at the same time a large amount of a toner is replenished, therefore, the stirring time of a toner in a developing device becomes shortened. When the conventional toner as described above is used during the image forming as described above, there has been a problem that the rising of the toner charge amount is deteriorated, and the density unevenness occurs.

Therefore, an object of the present invention is to provide a toner for electrostatic charge image development, with which the rising of the toner charge amount is improved while ensuring the low temperature fixability, and a high quality image having less density unevenness can be obtained even during the image forming at a high speed and a high printing rate.

To achieve at least one of the above-described objects, a toner for electrostatic charge image development reflecting one aspect of the present invention includes: a toner base particle having at least a binder resin, a releasing agent, and a colorant, wherein the following formula (1) is satisfied wherein a maximum value and a minimum value of a dielectric loss tangent tan δ, which are obtained by measuring at a frequency in the range of 1 kHz to 100 kHz under the condition at a temperature of 20° C. and a relative humidity of 50% RH, are defined as tan $\delta_{max}$ and tan $\delta_{min}$, respectively.

$$\text{Frequency showing tan } \delta_{max} < \text{Frequency showing tan } \delta_{min} \quad (1)$$

BRIEF DESCRIPTION OF THE DRAWINGS

FIGURE is a graph showing the relationship between the frequency and the tan δ of each of the toners in Examples 1 and 3, and Comparative Example 1.

DETAILED DESCRIPTION

The present invention is a toner for electrostatic charge image development, containing toner base particles having at least a binder resin, a releasing agent, and a colorant, in which the following formula (1) is satisfied wherein a maximum value and a minimum value of a dielectric loss tangent tan δ, which are obtained by measuring at a frequency in the range of 1 kHz to 100 kHz under the condition at a temperature of 20° C. and a relative humidity of 50% RH, are defined as tan $\delta_{max}$ and tan $\delta_{min}$, respectively.

$$\text{Frequency showing tan } \delta_{max} < \text{Frequency showing tan } \delta_{min} \quad (1)$$

According to the toner for electrostatic charge image development of the present invention having such a constitution, the rising of the toner charge amount is improved while ensuring the low temperature fixability, and a high quality image having less density unevenness can be obtained even during the image forming at a high speed and a high printing rate. That is, according to the present invention, a toner for electrostatic charge image development, with which the rising of the toner charge amount is improved while ensuring the low temperature fixability, and a high quality image having less density unevenness can be obtained even during the image forming at a high speed and a high printing rate, is provided.

The conductivity of a toner is considered mainly by ion conduction and electron conduction, and it is presumed that the electron conduction by the free electrons possessed by a colorant or the like relates to ∈" in a high frequency region (until around 100 kHz). In addition, it is also presumed that the ion conduction, which may occur by the hydrogen ions, positive ions of a group 1 element such as Na ions and K ions, or the like contained in a binder resin relates to ∈" in a low frequency region (around 1000 Hz), and further, it is considered that the frequency dependence of tan δ varies with the balance.

The detailed mechanism in present invention is unknown, but the tan δ in a higher frequency region is lowered, whereby the electric charge is hardly leaked and the chargeability becomes favorable. As a result, it is considered that with the toner satisfying the above formula (1), the rising of the toner charge amount is improved, and a high quality image having less density unevenness can be formed even during the image forming at a high speed and a high printing rate.

Further, the above-described mechanism is due to presumption, and the present invention should not be limited at all by the above-described mechanism.

Hereinafter, the embodiments of the present invention will be described. However, the present invention is not limited only to the following embodiments. Further, unless otherwise specifically noted, operations and measurements of properties and the like are performed under the conditions of room temperature (20 to 25° C.)/relative humidity 40 to 50% RH. In the present specification, the toner for electrostatic charge image development of the present invention is also sometimes referred to as simply a "toner of the present invention" or a "toner".

The constituent elements of the toner of the present invention will be described.

[Toner Base Particles]

Toner base particles are particles including at least a binder resin, a releasing agent, and a colorant, and in which other additive agents (internal additives) are contained as necessary. By adding external additives to the toner base particles, a toner is produced.

<Binder Resin>

A resin contained in the binder resin according to the present invention is not particularly limited, and a crystalline resin and an amorphous resin can be mentioned. Among them, it is preferred to contain a crystalline resin. By containing a crystalline resin, the low temperature fixability is ensured.

[Crystalline Resin]

In the present invention, the crystalline resin means a crystalline resin having a definite endothermic peak in the DSC curve obtained by the measurement using a differential scanning calorimeter, "Diamond DSC" (manufactured by PerkinElmer, Inc.). Examples of the crystalline resin include a crystalline polyester resin (CPES), a crystalline polyurethane resin, a crystalline polyurea resin, a crystalline polyamide resin, and a crystalline polyether resin, but from the viewpoint of the chargeability and the low temperature fixability, in particular, a crystalline polyester resin is preferably used. Therefore, according to a preferred embodiment of the present invention, the above-described crystalline resin is a crystalline polyester resin. Hereinafter, the crystalline polyester resin will be described.

[Crystalline Polyester Resin (CPES)]

A crystalline polyester resin means a known polyester resin obtained by polycondensation reaction of divalent or higher carboxylic acid (a polyvalent carboxylic acid component) with dihydric or higher alcohol (a polyhydric alcohol component), and means a resin having crystallinity.

The melting point of the crystalline polyester resin is preferably 55° C. or more to 90° C. or less, and more preferably 70° C. or more to 85° C. or less. When the melting point of the crystalline polyester resin is in the above-described range, sufficient low temperature fixability can be obtained. Further, the melting point of the crystalline polyester resin can be controlled by the resin composition.

In addition, the weight average molecular weight (Mw) of the crystalline polyester resin is preferably 5,000 to 100,000, more preferably 10,000 to 80,000, and particularly preferably 15,000 to 50,000. The number average molecular weight (Mn) is preferably 2,000 to 20,000, and more preferably 3,000 to 15,000.

Each valency number of a polyvalent carboxylic acid component and a polyhydric alcohol component is preferably 2 to 3, respectively, and particularly preferably 2. Therefore, as a particularly preferred embodiment, a case where each valency number is 2 (that is, a dicarboxylic acid component, and a diol component) will be explained.

As the dicarboxylic acid component, aliphatic dicarboxylic acid is preferably used, and aromatic dicarboxylic acid may be used in combination. As the aliphatic dicarboxylic acid, straight chain-type aliphatic dicarboxylic acid is preferably used. By using the straight chain-type aliphatic dicarboxylic acid, there is an advantage that the crystallinity is improved. The dicarboxylic acid component is not limited to one kind, and may be used by mixing two or more kinds thereof.

Examples of the aliphatic dicarboxylic acid include oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid (dodecanedioic acid), 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, and 1,18-octadecane dicarboxylic acid.

Among the above-described aliphatic dicarboxylic acids, because the effects of the present invention are easily obtained as described above, aliphatic dicarboxylic acid having 6 to 14 carbon atoms is preferred. Examples of the aromatic dicarboxylic acid capable of being used together with the aliphatic dicarboxylic acid include phthalic acid, terephthalic acid, isophthalic acid, o-phthalic acid, t-butyl isophthalic acid, 2,6-naphthalene dicarboxylic acid, and 4,4'-biphenyl dicarboxylic acid. Among them, from the viewpoint of the easiness of availability and the easiness of emulsification, terephthalic acid, isophthalic acid, and t-butyl isophthalic acid are preferably used. In addition, trivalent or higher polyvalent carboxylic acid such as trimellitic acid and pyromellitic acid, and an anhydride of the above-described carboxylic acid compounds, an alkyl ester of the above-described carboxylic acid having 1 to 3 carbon atoms, or the like may be used.

As to the dicarboxylic acid component to form a crystalline polyester resin, the content of the aliphatic dicarboxylic acid is preferably 50 constitution mol % or more, more preferably 70 constitution mol % or more, furthermore preferably 80 constitution mol % or more, and particularly preferably 100 constitution mol %. By setting the content of the aliphatic dicarboxylic acid in the dicarboxylic acid component to 50 constitution mol % or more, the crystallinity of the crystalline polyester resin can be sufficiently ensured.

In addition, as the diol component, aliphatic diol is preferably used, and diol other than the aliphatic diol may be contained as necessary. As the aliphatic diol, straight chain-type aliphatic diol is preferably used. By using the straight chain-type aliphatic diol, there is an advantage that the crystallinity is improved. The diol component may be used singly alone, or may be used by two or more kinds thereof.

Examples of the aliphatic diol include ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecane diol, 1,18-octadecanediol, 1,20-eicosanediol, and neopentyl glycol.

As to the diol component to forma crystalline polyester resin, the content of the aliphatic diol is preferably 50 constitution mol % or more, more preferably 70 constitution mol % or more, furthermore preferably 80 constitution mol % or more, and particularly preferably 100 constitution mol %. By setting the content of the aliphatic diol in the diol components to 50 constitution mol % or more, the crystallinity of the crystalline polyester resin can be ensured, and the excellent low temperature fixability is obtained in the toner to be produced, and further the glossiness is obtained in the image to be finally formed.

As to the use ratio of the diol component and the dicarboxylic acid component, the equivalent ratio of the hydroxyl group [OH] of the diol component and the carboxyl group [COOH] of the dicarboxylic acid component, [OH]/[COOH] is preferably 2.0/1.0 to 1.0/2.0.

In addition, in the present invention, the acid value of the crystalline polyester resin is preferably 4.0 mgKOH/g or more, more preferably 6.0 mgKOH/g or more, and furthermore preferably 15 mgKOH/g or more; and further, preferably 33 mgKOH/g or less, and more preferably 30 mgKOH/g or less. That is, in a preferred embodiment of the present invention, the acid value of the crystalline polyester resin is 15 to 30 mgKOH/g. In the range described above, the affinity between the crystalline polyester resin and the colorant is enhanced, the concentration to be required can be output, and stable image density can be realized over a long period of time during the printing at a high speed and a high printing rate.

In addition, the acid value can be controlled by the kind or composition ratio of the diol component and the dicarboxylic acid component, the adjustment of each amount of the catalyst and the polymerization initiator, which are used in polycondensation reaction, and the reaction conditions of the reaction temperature, the time and the like. Further, as the reaction time is longer, the molecular weight tends to become higher, and according to this, the acid value tends to be lowered.

The production method of the crystalline polyester resin is not particularly limited, and the crystalline polyester resin can be produced by the polycondensation (esterification) of the polyvalent carboxylic acid component and the polyhydric alcohol component using a known esterification catalyst.

Examples of the catalyst usable during the production of a crystalline polyester resin include an alkali metal compound of sodium, lithium, or the like; a compound containing a group 2 element such as magnesium, or calcium; a compound of a metal such as aluminum, zinc, manganese, antimony, titanium, tin, zirconium, and germanium; a phosphorous acid compound; a phosphoric acid compound; and an amine compound. Specifically, examples of the tin compound include dibutyltin oxide, tin octylate, tin dioctylate, and a salt thereof. Examples of the titanium compound include titanium alkoxide such as tetra-n-butyl titanate ($Ti(O\text{-}n\text{-}Bu)_4$), tetraisopropyl titanate, tetramethyl titanate, and tetrastearyl titanate; titanium acylate such as polyhydroxy titanium stearate; and titanium chelate such as titanium tetraacetylacetonate, titanium lactate, and titanium triethanolaminate. Examples of the germanium compound include germanium dioxide. Further, examples of the aluminum compound include an oxide such as poly aluminum hydroxide, an aluminum alkoxide, and tributyl aluminate. These may be used singly alone or in combination of two or more kinds thereof.

The polymerization temperature is not particularly limited, can be appropriately adjusted in order to obtain an intended product, and is preferably 70 to 250° C. In addition, the polymerization time is not particularly limited, but preferably 0.5 to 10 hours. During the polymerization, inside the reaction system may be decompressed as necessary.

(Hybrid Crystalline Polyester Resin)

In the present invention, it is preferred that a hybrid crystalline polyester resin containing part of the structure of an amorphous resin is used in the toner base particles. By using a hybrid crystalline polyester resin, there is an advantage that the affinity for an amorphous resin that can be used as a binder resin as described later can be improved. That is, according to the present invention, the crystalline polyester resin is more preferably a hybrid crystalline polyester resin.

In a preferred embodiment of the present invention, the hybrid crystalline polyester resin is a resin in which a crystalline polyester polymerization segment and an amorphous polymerization segment are chemically bonded. That is, according to a preferred embodiment of the present invention, the above-described crystalline resin has a structure in which a crystalline polyester polymerization segment and an amorphous polymerization segment are of chemically bonded. In the embodiment as in the above, the affinity between a hybrid crystalline polyester resin (a crystalline polyester resin) and an amorphous resin that can be used as a binder resin can be improved in the toner base particles, and uneven distribution of the crystalline polyester resin can be suppressed. In addition, by controlling the crystallinity, it is presumed that a technical effect of improving the environmental stability is provided.

The chemically bonded structure is not particularly limited either, but it is preferred that the crystalline polyester polymerization segment is grafted to an amorphous polymerization segment as a main chain. That is, it is preferred that the hybrid crystalline polyester resin is a graft copolymer having the amorphous polymerization segment as the main chain and having the crystalline polyester polymerization segment as the side chain. In the embodiment as in the above, the orientation of the crystalline polyester polymerization segment can be further aligned, the crystallinity of the hybrid crystalline polyester resin can be further improved, and there is an advantage that fine dispersion can be performed inside the toner without impairing the crystallinity.

More specifically, as the hybrid crystalline polyester resin, a hybrid crystalline polyester resin in which a crystalline polyester polymerization segment that is a side chain is bonded to the main chain of a styrene-acrylic polymerization segment that is an amorphous polymerization segment is preferred.

<Crystalline Polyester Polymerization Segment>

The crystalline polyester polymerization segment indicates a portion derived from a crystalline polyester resin. That is, the crystalline polyester polymerization segment indicates a molecule chain having the same chemical structure as that forming a crystalline polyester resin.

The weight average molecular weight (Mw) of the hybrid crystalline polyester resin is preferably 5,000 to 100,000, more preferably 6,000 to 50,000, and furthermore preferably 6,500 to 40,000. The number average molecular weight (Mn) is preferably 100 to 50,000, and more preferably 1,000 to 10,000.

The melting point of the hybrid crystalline polyester resin is preferably 55° C. or more to 90° C. or less, and more preferably 65° C. or more to 85° C. or less.

The crystalline polyester polymerization segment is similar to the above-described crystalline polyester resin, and is a portion derived from a known polyester resin that is obtained by polycondensation reaction of a polyvalent carboxylic acid component and a polyhydric alcohol component. The polyvalent carboxylic acid component and the polyhydric alcohol component, which form a crystalline polyester polymerization segment, are similar to those for the above-described crystalline polyester resin, therefore, the description is omitted.

The content of the crystalline polyester polymerization segment is preferably 80% by mass or more to 98% by mass or less, and more preferably 90% by mass or more to 95% by mass or less relative to the total amount of the hybrid crystalline polyester resin. By setting the content in the above-described range, sufficient crystallinity can be imparted to the hybrid crystalline polyester resin. In addition, the constituent components and the content ratio of each segment in the hybrid crystalline polyester resin can be specified by, for example, NMR measurement, and methylation reaction P-GC/MS measurement.

The hybrid crystalline polyester resin contains an amorphous polymerization segment in addition to the crystalline polyester polymerization segment. By forming to a graft copolymer, the orientation of the crystalline polyester polymerization segment can be easily controlled, and sufficient crystallinity can be imparted to the hybrid crystalline polyester resin.

<Amorphous Polymerization Segment>

An amorphous polymerization segment indicates a portion derived from an amorphous resin, that is, indicates a molecule chain having the same chemical structure as that forming an amorphous resin. In the case where an amorphous resin is contained in the binder resin according to the present invention, the amorphous polymerization segment contributes to the affinity between the amorphous resin and the hybrid crystalline polyester resin. It can be confirmed that the hybrid crystalline polyester resin contains an amorphous polymerization segment, by specifying the chemical structure with the use of, for example, NMR measurement, and methylation reaction P-GC/MS measurement.

In addition, the amorphous polymerization segment is a polymerization segment which does not have a melting point but has relatively high glass transition temperature (Tg) when a resin having the same chemical structure and molecular weight as those of the segment is subjected to differential scanning calorimetry (DSC).

The content of the amorphous polymerization segment is preferably 2% by mass or more to 20% by mass or less, and more preferably 5% by mass or more to 10% by mass or less in a hybrid crystalline polyester resin. By setting the content in the above-described range, sufficient crystallinity can be imparted to the hybrid crystalline polyester resin.

In the case where an amorphous resin is contained in the binder resin according to the present invention, the amorphous polymerization segment is preferably formed by a resin that is the same kind as that of the amorphous resin. In the embodiment as in the above, the affinity between the hybrid crystalline polyester resin and a binder resin to be a matrix is further improved.

Herein, the expression of "resin that is the same kind" means a resin in which a characteristic chemical bond is commonly included in a repeating unit. Herein, the expression of "characteristic chemical bond" is in accordance with the "Polymer classification" described in National Institute for Materials Science (NIMS) Materials Database (http://polymer.nims.go.jp/PoLyInfo/guide/jp/term_polymer.html). That is, a chemical bond forming a polymer that is classified into 22 kinds in total of polyacryl, polyamide, polyacid anhydride, polycarbonate, polydiene, polyester, polyhaloolefin, polyimide, polyimine, polyketone, polyolefin, polyether, polyphenylene, polyphosphazene, polysiloxane, polystyrene, polysulfide, polysulfone, polyurethane, polyurea, polyvinyl, and other polymers is referred to as a "characteristic chemical bond".

In addition, the expression of "resin that is the same kind" when the resin is a copolymer indicates each of the resins having a characteristic chemical bond common to each other in the case where a monomer species having the above-described chemical bond is contained as a constituent unit in a chemical structure of plural monomer species that constitute the copolymer. Accordingly, even in the case where the characteristics shown by the resins themselves are different from each other, or the case where the molar component ratios of the monomer species that form the copolymer are different from each other, when the resins have the characteristic chemical bond common to each other, the resins are regarded as the resin that is the same kind as each other (the resin in the same kind as each other).

For example, a resin (or polymerization segment) formed by styrene, butyl acrylate, and acrylic acid, and a resin (or polymerization segment) formed by styrene, butyl acrylate, and methacrylic acid have at least a chemical bond constituting polyacryl, therefore, these are resins in the same kind.

The resin component forming an amorphous polymerization segment is not particularly limited, but examples of the resin component include a vinyl polymerization segment, a urethane polymerization segment, and a urea polymerization segment. Among them, because the thermoplasticity is easily controlled, a vinyl polymerization segment is preferred.

The vinyl polymerization segment is not particularly limited as long as being obtained by the polymerization of a vinyl compound, but examples of the vinyl polymerization segment include an acrylic ester polymerization segment, a styrene-acrylic ester polymerization segment, and an ethylene-vinyl acetate polymerization segment. These may be used singly alone or in combination of two or more kinds thereof.

Among the above-described vinyl polymerization segments, in consideration of the plasticity at the time of heat fixing, a styrene-acrylic ester polymerization segment (styrene-acryl polymerization segment) is preferred. Therefore, hereinafter, a styrene-acryl polymerization segment as an amorphous polymerization segment will be described.

The styrene-acryl polymerization segment is formed by the addition polymerization of at least a styrene monomer and a (meth)acrylic ester monomer. The styrene monomer referred to herein includes styrene represented by a structural formula of $CH_2{=}CH{-}C_6H_5$, and further includes styrene derivative with a structure having a known side chain or a functional group. In addition, a (meth)acrylic ester monomer referred to herein contains an acrylic ester compound represented by $CH_2{=}CHCOOR$ (R represents an alkyl group), a methacrylic ester compound represented by $CH_2{=}C(CH_3)$ COOR (R represents an alkyl group), and further contains an acrylic ester derivative, a methacrylic ester derivative, which have a known side chain or a functional group, or the like.

Hereinafter, specific examples of the styrene monomer and the (meth)acrylic ester monomer, which can form a styrene-acryl polymerization segment, are shown, but the monomers capable of being used for forming a styrene-acryl polymerization segment that is used in the present invention are not limited to the following.

Firstly, specific examples of the styrene monomer include styrene, o-methyl styrene, m-methyl styrene, p-methyl styrene, α-methyl styrene, p-phenyl styrene, p-ethyl styrene, 2,4-dimethyl styrene, p-tert-butyl styrene, p-n-hexyl styrene, p-n-octyl styrene, p-n-nonyl styrene, p-n-decyl styrene, and p-n-dodecylstyrene. These styrene monomers can be used alone or in combination of two or more kinds thereof.

In addition, specific examples of the (meth)acrylic ester monomer include an acrylic ester monomer such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; and a methacrylic ester such as methyl methacrylate, ethyl methacrylate, n-butyl methacrylate, isopropyl methacrylate, isobutylmethacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate. Among them, a long-chain acrylic ester monomer is preferably used. Specifically, methyl acrylate, n-butyl acrylate, and 2-ethylhexyl acrylate are preferred.

In addition, in the present specification, the expression of "(meth)acrylic ester monomer" is a generic term for an "acrylic ester monomer" and a "methacrylic ester monomer", and for example, "methyl (meth)acrylate" is a generic term for "methyl acrylate" and "methyl methacrylate".

These acrylic ester monomers or methacrylic ester monomers can be used alone or in combination of two or more kinds thereof. That is, forming a copolymer by using a styrene monomer and two or more kinds of acrylic ester monomers, forming a copolymer by using a styrene monomer and two or more kinds of methacrylic ester monomers, and forming a copolymer by using a styrene monomer in combination with an acrylic ester monomer and a methacrylic ester monomer, any one which can be performed.

The content of the constituent units derived from a styrene monomer in the amorphous polymerization segments is preferably 40 to 90% by mass relative to the total amount of the amorphous polymerization segments. In addition, the content of the constituent units derived from a (meth)acrylic ester monomer in the amorphous polymerization segments is preferably 10 to 60% by mass relative to the total amount of the amorphous polymerization segments.

Further, the amorphous polymerization segment is preferably formed by the addition polymerization of a compound for chemical bonding to the above-described crystalline polyester polymerization segment, in addition to the above-described styrene monomer and (meth)acrylic ester monomer. Specifically, a compound, which forms ester-bond to a hydroxyl group [—OH] derived from a polyhydric alcohol component or a carboxyl group [—COOH] derived from a polyvalent carboxylic acid component, contained in the above-described crystalline polyester polymerization segment, is preferably used. Therefore, the amorphous polymerization segment is preferably formed by further polymerizing a compound which can be addition-polymerized to the styrene monomer and the (meth)acrylic ester monomer, and has a carboxyl group [—COOH] or a hydroxyl group [—OH].

Examples of the compound described above include a compound having a carboxyl group, such as acrylic acid, methacrylic acid, maleic acid, itaconic acid, cinnamic acid, fumaric acid, maleic acid monoalkyl ester, and itaconic acid monoalkyl ester; and a compound having a hydroxyl group, such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate, and polyethylene glycol mono(meth)acrylate.

The content of the constituent units derived from the above-described compound in the amorphous polymerization segments is preferably 0.5 to 20% by mass relative to the total amount of the amorphous polymerization segments.

The forming method of a styrene-acryl polymerization segment is not particularly limited, and a method in which monomers are polymerized by using a known oil-soluble or water-soluble polymerization initiator can be mentioned. As the oil-soluble polymerization initiator, specifically, an azo-based or diazo-based polymerization initiator or a peroxide-based polymerization initiator, which is shown in the following, is mentioned.

Examples of the azo-based or diazo-based polymerization initiator include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

Examples of the peroxide-based polymerization initiator include benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl) propane, and tris-(t-butylperoxy)triazine.

In addition, in the case where resin particles are formed by an emulsion polymerization method, a water-soluble radical polymerization initiator can be used. Examples of the water-soluble radical polymerization initiator include a persulfate such as potassium persulfate, and ammonium persulfate, azobisaminodipropane acetate, azobiscyanovaleric acid and a salt thereof, and hydrogen peroxide.

(Production Method of Hybrid Crystalline Polyester Resin)

The production method of the hybrid crystalline polyester resin contained in the binder resin according to the present invention is not particularly limited as long as the method can form a polymer having a structure in which a crystalline polyester polymerization segment and an amorphous polymerization segment are chemically bonded. As the production method of the hybrid crystalline polyester resin, for example, the following methods can be mentioned.

(a) A method in which an amorphous polymerization segment is preliminarily polymerized, then polymerization reaction is performed to form a crystalline polyester polymerization segment in the presence of the amorphous polymerization segment and a hybrid crystalline polyester resin is produced.

In this method, at first by the addition reaction of a monomer constituting the above-described amorphous polymerization segment (preferably, a vinyl monomer such as a styrene monomer and a (meth)acrylic ester monomer), an amorphous polymerization segment is formed. Next, by the polymerization reaction of a polyvalent carboxylic acid component and a polyhydric alcohol component in the presence of the amorphous polymerization segment, a crystalline polyester polymerization segment is formed. At this time, by the condensation reaction of a polyvalent carboxylic acid component and a polyhydric alcohol component, and further by the addition reaction of a polyvalent carboxylic acid component or a polyhydric alcohol component to the amorphous polymerization segment, a hybrid crystalline polyester resin is formed.

In the above-described method, it is preferred that a site capable of reacting these segments with each other is incorporated in the crystalline polyester polymerization segment or the amorphous polymerization segment. Specifically, at the time of forming an amorphous polymerization segment, in addition to a monomer constituting an amorphous polymerization segment, a compound having a site capable of reacting with a carboxyl group [—COOH] or a hydroxyl group [—OH], which is left in the crystalline polyester polymerization segment, and a site capable of reacting with an amorphous polymerization segment is also used. That is, by reacting the above-mentioned compound with a carboxyl group [—COOH] or a hydroxyl group [—OH] in the crystalline polyester polymerization segment, the crystalline polyester polymerization segment can be chemically bonded to an amorphous polymerization segment.

Alternatively, at the time of forming a crystalline polyester polymerization segment, a compound having a site capable of reacting with a polyhydric alcohol component or a polyvalent carboxylic acid component, and also capable of reacting with an amorphous polymerization segment may be used.

By using the above-described method, a hybrid crystalline polyester resin having a structure (graft structure) in which a crystalline polyester polymerization segment is chemically bonded to an amorphous polymerization segment can be formed.

The method of (a) is preferred because with the method, the hybrid crystalline polyester resin having a structure in which a crystalline polyester polymerization segment is grafted to an amorphous polymerization segment is easily formed, and the production process can be simplified. In addition, in the method of (a), the amorphous polymerization segment is preliminarily formed and then the crystalline polyester polymerization segment is bonded, therefore, the orientation of the crystalline polyester polymerization segment is easily uniformed. Accordingly, with the method, a hybrid crystalline polyester resin suitable for the toner defined in the present invention can be reliably formed, therefore, this method is preferred.

In addition, the method may be (b) a method in which a crystalline polyester polymerization segment and an amorphous polymerization segment are separately formed in advance, and then these segments are bonded to each other, and a hybrid crystalline polyester resin is produced; or may be (c) a method in which a crystalline polyester polymerization segment is preliminarily formed, and then polymerization reaction is performed to form an amorphous polymerization segment in the presence of the crystalline polyester polymerization segment, and a hybrid crystalline polyester resin is produced.

By using each of the above-described methods, a hybrid crystalline polyester resin having a structure (graft structure) in which a crystalline polyester polymerization segment is chemically bonded to an amorphous polymerization segment can be formed.

The content of the crystalline polyester resin in the toner base particles is preferably 1 to 15% by mass, and more preferably 7 to 12% by mass. In this range, the low temperature fixability becomes favorable, and the toner chargeability is improved.

[Amorphous Resin]

It is preferred that the toner base particles according to the present invention contain an amorphous resin. The amorphous resin is preferred when being constituted with a resin in the same kind as the amorphous polymerization segment of the hybrid crystalline polyester resin that is the above-described preferred crystalline resin, or an amorphous polyester resin. Herein, the expression of "constituted with a resin in the same kind" has the meaning that the form may be made by including only the resins in the same kind, or the form may be made by including not only the resins in the same kind but also other amorphous resins. However, in the case of the form including the resins in the same kind and other amorphous resins, the content of the resins in the same kind is preferably 15% by mass or more, and more preferably 20% by mass or more relative to the total amount of the amorphous resins.

Among them, as the amorphous resin, a vinyl resin or a styrene-acrylic modified polyester resin is preferred, and a vinyl resin is more preferred. Therefore, according to a preferred embodiment of the present invention, the binder resin contains a vinyl resin. By containing a vinyl resin, there is an advantage that the affinity for a releasing agent is improved and the fixability is also improved.

In the amorphous resin or the amorphous polyester resin, from the viewpoint that the plasticity is easily controlled, the weight average molecular weight (Mw) is preferably 5,000 to 150,000, and more preferably 10,000 to 90,000.

In addition, in the amorphous resin or the amorphous polyester resin, the number average molecular weight (Mn) is preferably 3,000 to 30,000, and more preferably 5,000 to 25,000. In the amorphous resin, the glass transition temperature (Tg) is preferably 25 to 70° C., and more preferably 35 to 65° C. Further, the softening point temperature is preferably 75 to 130° C., and more preferably 85 to 115° C.

[Vinyl Resin]

The vinyl resin is not particularly limited as long as being obtained by the polymerization of a vinyl compound, but examples of the vinyl resin include a (meth)acrylic ester resin, a styrene acrylic copolymer, and an ethylene vinyl acetate resin. These may be used singly alone or in combination of two or more kinds thereof. Among the above-described vinyl resins, in consideration of the manufacturability in an emulsion aggregation method (that is, latex having uniform cohesiveness is made, and the toner having a desired particle size distribution is obtained), or the plasticity at the time of heat fixing, a styrene-acrylic copolymer is preferred.

(Styrene-Acrylic Copolymer)

The styrene-acrylic copolymer referred to in the present invention is a copolymer formed by performing the polymerization using at least a styrene monomer and a (meth) acrylic ester monomer. Herein, the styrene monomer includes styrene represented by a structural formula of $CH_2{=}CH{-}C_6H_5$, and further includes derivatives with a structure having a known side chain or a functional group in the styrene structure.

Further, the (meth)acrylic ester monomer has a functional group having an ester bond in the side chain. Specifically, in addition to an acrylic ester monomer represented by $CH_2{=}CHCOOR$ (R represents an alkyl group), a vinyl-based ester compound such as a methacrylic ester monomer represented by $CH_2{=}C(CH_3)$ COOR (R represents an alkyl group) is included.

Hereinafter, specific examples of the styrene monomer and the (meth)acrylic ester monomer, which can form a styrene-acrylic copolymer, are shown, but not limited to the following ones.

Examples of the styrene monomer include styrene, o-methyl styrene, m-methyl styrene, p-methyl styrene, α-methyl styrene, p-phenyl styrene, p-ethyl styrene, 2,4-dimethyl styrene, p-tert-butyl styrene, p-n-hexyl styrene, p-n-octyl styrene, p-n-nonyl styrene, p-n-decyl styrene, and p-n-dodecyl styrene.

In addition, as the (meth)acrylic ester monomer, the following acrylic ester monomers and methacrylic ester monomers are typical ones. Examples of the acrylic ester monomer include methyl acrylate, ethyl acrylate, n-propyl acrylate, isopropyl acrylate, n-butyl acrylate, isobutyl acrylate, t-butyl acrylate, n-octyl acrylate, 2-ethylhexyl acrylate, stearyl acrylate, lauryl acrylate, and phenyl acrylate phenyl. Examples of the methacrylic ester monomer include methyl methacrylate, ethyl methacrylate, n-propyl methacrylate, isopropyl methacrylate, n-butyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate.

These styrene monomers, acrylic ester monomers, and methacrylic ester monomers can be used singly alone or in combination of two or more kinds thereof.

Further, in the styrene-acrylic copolymer, in addition to the copolymer formed only by the above-described styrene monomers and (meth)acrylic ester monomers, there is also a copolymer formed by these styrene monomers and (meth) acrylic ester monomers, and further in combination with a vinyl monomer generally used. Hereinafter, a vinyl monomer that can be used in combination when the styrene-acrylic copolymer referred to in the present invention is formed is mentioned, but the vinyl monomer that can be used in combination is not limited to the following ones.

(1) Olefins

Ethylene, propylene, isobutylene, and the like.

(2) Vinyl Esters

Vinyl propionate, vinyl acetate, vinyl benzoate, and the like.

(3) Vinyl Ethers

Vinylmethyl ether, vinylethyl ether, and the like.

(4) Vinyl Ketones

Vinylmethyl ketone, vinylethyl ketone, vinylhexyl ketone, and the like.

(5) N-Vinyl Compounds

N-Vinyl carbazole, N-vinyl indole, N-vinyl pyrrolidone, and the like.

(6) Others

Vinyl compounds such as vinylnaphthalene, and vinylpyridine; an acrylic acid or methacrylic acid derivative such as acrylonitrile, methacrylonitrile, and acrylamide; and the like.

In addition, by using a polyfunctional vinyl monomer, a resin having a crosslinking structure can be prepared. Further, a vinyl monomer having an ionic dissociation group in the side chain can be used. Specific examples of the ionic dissociation group include a carboxyl group, a sulfonate group, and a phosphate group. Specific examples of the vinylmonomers having these ionic dissociation groups are shown hereinafter.

Specific examples of the vinyl monomer having a carboxyl group include acrylic acid, methacrylic acid, maleic acid, itaconic acid, cinnamic acid, fumaric acid, maleic acid monoalkyl ester, and itaconic acid monoalkyl ester.

The forming method of the styrene-acrylic copolymer is not particularly limited, and a method in which monomers are polymerized by using a known oil-soluble or water-soluble polymerization initiator can be mentioned. The specific examples of the oil-soluble polymerization initiator or the water-soluble polymerization initiator are similar to those in the content described above, therefore, the description herein is omitted. As necessary, for example, a known chain transfer agent such as n-octyl-3-mercaptopropionate may be used.

In the case where the styrene-acrylic copolymer used in the present invention is formed, the content of the styrene monomer and the acrylic ester monomer is not particularly limited, and can be appropriately adjusted from the viewpoint of the adjustment of the softening point temperature or the glass transition temperature of the binder resin. Specifically, the content of the styrene monomer is preferably 40 to 95% by mass, and more preferably 50 to 80% by mass relative to the whole monomers. Further, the content of the acrylic ester monomer is preferably 5 to 60% by mass, and more preferably 20 to 50% by mass relative to the whole monomers.

The molecular weight of the styrene-acrylic copolymer is preferably 2,000 to 1,000,000 in weight average molecular weight (Mw). Further, the number average molecular weight (Mn) is preferably 1,000 to 100,000. Furthermore, the molecular weight distribution (Mw/Mn) is preferably 1.5 to 100, and more preferably 1.8 to 70. By setting the weight average molecular weight (Mw), the number average molecular weight (Mn) or the molecular weight distribution (Mw/Mn) of the styrene-acrylic copolymer in the above-described ranges, an effect on inhibiting the generation of off-set phenomenon in the fixing process when printing is performed using the prepared toner is exerted. In addition, the glass transition temperature of the styrene-acrylic copolymer is preferably 30 to 70° C., and further the softening point temperature is preferably 80 to 170° C. By setting the glass transition temperature or the softening point temperature to the above-described ranges, favorable fixability is obtained.

[Amorphous Polyester Resin]

The amorphous polyester resin means a resin that is obtained by the polycondensation reaction of a polyvalent carboxylic acid component (or a derivative thereof) and a polyhydric alcohol component (or a derivative thereof), and has no distinct melting point.

As the derivative of the polyvalent carboxylic acid component, an alkyl ester of the polyvalent carboxylic acid component, an acid anhydride, and an acid chloride can be used, and as the derivative of the polyhydric alcohol component, an ester compound of the polyhydric alcohol component, and hydroxycarboxylic acid can be used.

Examples of the polyvalent carboxylic acid component include divalent carboxylic acid such as oxalic acid, succinic acid, maleic acid, mesaconic acid, adipic acid, β-methyladipic acid, azelaic acid, sebacic acid, nonane dicarboxylic acid, decane dicarboxylic acid, undecane dicarboxylic acid, dodecane dicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid, and dodecenylsuccinic acid; and trivalent or higher carboxylic acid such as trimellitic acid, pyromellitic acid, naphthalene tricarboxylic acid, naphthalene tetracarboxylic acid, pyrene tricarboxylic acid, and pyrene tetracarboxylic acid.

Examples of the polyhydric alcohol component include dihydric alcohol such as ethylene glycol, propylene glycol, butanediol, diethylene glycol, hexanediol, cyclohexanediol, octanediol, decanediol, dodecanediol, an ethylene oxide adduct of bisphenol A, and a propylene oxide adduct of bisphenol A; and trihydric or higher polyol such as glycerin, pentaerythritol, hexamethylol melamine, hexaethylol melamine, tetramethylol benzoguanamine, and tetraethylol benzoguanamine.

As the catalyst to synthesize the amorphous polyester resin, conventionally known various catalysts can be used.

In addition, the number average molecular weight (Mn) and the weight average molecular weight (Mw) of the binder resin forming a toner can be calculated by a molecular weight measurement method. Hereinafter, a molecular weight measurement procedure by gel permeation chromatography (GPC) using tetrahydrofuran (THF) as a column solvent, which is one of the representative examples of the molecular weight measurement method, will be described.

Specifically, 1 ml of THF (use of degassed one) is added to 1 mg of a measurement sample, and the resultant mixture is subjected to a stirring treatment by using a magnetic stirrer under room temperature, and sufficiently dissolved. Subsequently, the mixture is treated by a membrane filter having a pore size of 0.45 to 0.50 μm, and then injected into a GPC apparatus.

As to the GPC measurement conditions, a column is stabilized at 40° C., THF is flowed at a flow rate of 1 ml per minute, around 100 μl of a sample at a concentration of 1 mg/ml is injected into the column, and measured. The column is used preferably in combination with a polystyrene gel column that is available on the market. For example, there are a combination with Shodex GPC KF-801, 802, 803, 804, 805, 806, or 807 manufactured by SHOWA DENKO K.K., a combination with TSKgel G1000H, G2000H, G3000H, G4000H, G5000H, G6000H, G7000H, GMHXL, or TSK guard column manufactured by TOSOH CORPORATION, and the like.

As the detector, a refractive index detector (RI detector), or a UV detector is preferably used. In the molecular weight measurement of the sample, the molecular weight distribution of the sample is calculated with the use of the calibration curve made by using monodisperse polystyrene standard particles. Around 10 kinds of the polystyrene standard particles are preferably used for making the calibration curve.

The molecular weight measurement can be performed, for example, under the following measurement conditions.

(Measurement Conditions)

Apparatus: HLC-8020 (manufactured by TOSOH CORPORATION)

Column: GMHXL×2, and G2000HXL×1

Detector: at least one of RI and UV

Eluate flow rate: 1.0 ml/minute

Sample concentration: 0.01 g/20 ml

Sample amount: 100 μl

Calibration curve: made by standard polystyrene

In addition, the toner base particles according to the present invention may be a single layer structure or a core-shell structure, but is preferably a core-shell structure. When the toner base particles have a core-shell structure, the heat resistance is improved while maintaining the low temperature fixability. In addition, similarly, from the viewpoint that the heat resistance is improved while maintaining the low temperature fixability, a shell portion of the core-shell structure is preferably formed by an amorphous polyester resin. As the production method of toner base particles having a core-shell structure, conventionally known knowledge is appropriately employed.

In a preferred embodiment of the present invention, the content of a crystalline resin in the toner base particles is, from the viewpoint of the low temperature fixability and the chargeability, preferably 1 to 15% by mass, and more preferably 7 to 12% by mass. In addition, in a preferred embodiment of the present invention, the content of an amorphous resin in the toner base particles is, from the viewpoint of the chargeability and the low temperature fixability, preferably 40 to 90% by mass, and more preferably 48 to 89% by mass.

[Releasing Agent]

The toner base particles of the present invention contain a releasing agent (wax). Examples of the releasing agent include hydrocarbon-based waxes, ester-based waxes, natural product-based waxes, and amide-based waxes. In the toner of the present invention, it is preferred that the releasing agent contains ester-based wax or hydrocarbon-based wax. These releasing agents are suitable for the toner of the present invention, and by using these releasing agents, the fixing separability of the toner is improved.

Examples of the hydrocarbon-based waxes include polyethylene wax with a low molecular weight, polypropylene wax, further microcrystalline wax, Fischer-Tropsch wax, and paraffin wax.

Examples of the ester-based waxes include an ester of higher fatty acid and higher alcohols such as behenyl behenate, ethylene glycol stearic acid ester, ethylene glycol behenic acid ester, neopentyl glycol stearic acid ester, neopentyl glycol behenic acid ester, 1,6-hexanediol stearic acid ester, 1,6-hexanediol behenic acid ester, glycerol stearic acid ester, glycerol behenic acid ester, pentaerythritol tetrastearic acid ester, pentaerythritol tetrabehenic acid ester, stearyl citrate, behenyl citrate, stearyl malate, and behenyl malate. Among them, from the viewpoint of the chargeability and the fixability, behenyl behenate, pentaerythritol tetrabehenic acid ester, fatty acid polyglycerin ester, glycerol behenic acid ester, stearyl behenate, and the like are preferred. These releasing agents can be used alone or in combination of two or more kinds thereof.

The melting point of the releasing agent is preferably 40 to 160° C., and more preferably 60 to 100° C. By setting the melting point in the range, the heat resistant storage stability of the toner is ensured, and further, stable toner image can be formed without causing any cold offset or the like even in the case where the fixing is performed at low temperature. Further, the content of the releasing agent in the toner base particles is, preferably 1 to 30% by mass, and more preferably 3 to 20% by mass.

In addition, the method of adding the releasing agent to the toner base particles is not particularly limited, and a releasing agent particle dispersion solution is separately prepared, and by mixing the prepared dispersion solution with a dispersion liquid of other constituent components of the toner base particles, the releasing agent may be contained in the toner base particles, or when the raw material components of the binder resin are polymerized, the releasing agent may be contained together with the raw material components. When the method is the former method, a technical effect on the improvement of the low temperature fixability is exerted, and when the method is the latter method, a technical effect on the improvement of the chargeability is exerted.

[Colorant]

In the present invention, in order to produce a toner for electrostatic charge image development, a colorant is used. As the colorant, both of an achromatic colorant and a chromatic colorant can be used without having any limitation.

As the achromatic colorant, a black colorant can be mentioned. As the black colorant, carbon black, a magnetic material, iron.titanium composite oxide black, and the like can be used. Examples of the carbon black include channel black, furnace black, acetylene black, thermal black, and lamp black. Further, examples of the magnetic material include ferrite, and magnetite.

Examples of the chromatic colorant include a colorant for an orange or yellow toner, a colorant for a magenta or red toner, and a colorant for a green or cyan toner.

For the colorant for an orange or yellow toner, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, or the like as the dye, and C.I. Pigment Yellow 14, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, C.I. Pigment Yellow 185, or the like as the pigment can be used, and further a mixture of these ones can also be used.

For the colorant for a magenta or red toner, C.I. Solvent Red 1, C.I. Solvent Red 49, C.I. Solvent Red 52, C.I. Solvent Red 58, C.I. Solvent Red 63, C.I. Solvent Red 111, C.I. Solvent Red 122, or the like as the dye, and C.I. Pigment Red 5, C.I. Pigment Red 48:1, C.I. Pigment Red 53:1, C.I. Pigment Red 57:1, C.I. Pigment Red 122, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, or the like as the pigment can be used, and further a mixture of these ones can also be used.

For the colorant for a green or cyan toner, C.I. Solvent Blue 25, C.I. Solvent Blue 36, C.I. Solvent Blue 60, C.I. Solvent Blue 70, C.I. Solvent Blue 93, C.I. Solvent Blue 95, or the like as the dye, and C.I. Pigment Blue 1, C.I. Pigment Blue 7, C.I. Pigment Blue 15, C.I. Pigment Blue 60, C.I. Pigment Blue 62, C.I. Pigment Blue 66, C.I. Pigment Blue 76, C.I. Pigment Blue 15:3, or the like as the pigment can be used, and further a mixture of these ones can also be used.

These colorants can be used alone, or used in combination by selecting two or more kinds thereof.

The content of the colorant in the toner base particles is preferably 0.5 to 20% by mass, and more preferably 2 to 10% by mass.

Conventionally, by using a toner containing a crystalline resin as a binder resin, or a toner containing an achromatic colorant generally having conductivity as a colorant, the rising of the toner charge amount tends to be deteriorated. However, because the toner of the present invention has the characteristics of tan δ shown in the above formula (1), even if the toner contains a crystalline resin as a binder resin, or contains an achromatic colorant as a colorant, the rising of the toner charge amount is improved.

[Charge Control Agent]

The toner base particles of the present invention may contain a charge control agent.

As the charge control agent, various known compounds such as nigrosine-based dye, a metal salt of naphthenic acid or higher fatty acid, alkoxylated amine, a quaternary ammonium salt compound, an azo-based metal complex, and a salicylic acid metal salt can be used.

The additive amount of the charge control agent is usually 0.1 to 10% by mass, and preferably 0.5 to 5% by mass relative to 100% by mass of the binder resin in the toner particles to be finally obtained.

The particle size of the charge control agent is preferably 10 to 1000 nm, more preferably 50 to 500 nm, and further particularly preferably 80 to 300 nm in number average primary particle diameter.

Examples of the other additive agents include additionally a rhodamine-based dye, a triphenylmethane-based dye, and an alkyl amine.

<Particle Diameter of Toner Base Particles>

The particle diameter of the toner base particles of the present invention is preferably 3 to 8 μm in volume-based median diameter ($D_{50}$). This particle diameter, in the production method described later, can be controlled by the concentration of an aggregating agent and the fusing time, and further by the composition of the polymer itself. By setting the volume-based median diameter ($D_{50}$) to 3 to 8 μm, the reproducibility of fine lines, and the improvement of image quality of a photographic image can be achieved, and further the toner consumption can be reduced as compared with that in the case of using a toner with a large particle diameter. In addition, the volume-based median diameter ($D_{50}$) can be measured by using, for example, "Coulter Multisizer 3" (manufactured by Beckman Coulter, Inc.).

<Average Circularity of Toner Base Particles>

The average circularity shown by the following formula (3) of the toner base particles according to the present invention is usually 0.91 or more. That is, according to a preferred embodiment of the present invention, the average circularity is 0.91 or more. From the viewpoint of the improvement of transfer efficiency and the charge stability, the average circularity is preferably 0.920 to 0.995, and more preferably 0.930 to 0.975.

$$\text{Average circularity} = \text{Circumference length of circle determined from equivalent circle diameter} / \text{Circumference length of projection image of particle} \quad (3)$$

In addition, the average circularity can be measured by using, for example, a measuring apparatus of average circularity, "FPIA-2100" (manufactured by SYSMEX CORPORATION).

[External Additive]

The toner according to the present invention may contain external additive particles. The external additive is not particularly limited, but preferably inorganic particles having a number average primary particle diameter of around 2 to 800 nm. The kind of the external additive is not particularly limited, and examples of the external additive include the following known inorganic particles, and a lubricant. These external additives can be used alone or in combination of two or more kinds thereof.

As the inorganic particles, conventionally known ones can be used, and for example, silica, titania (titanium dioxide), alumina, strontium titanate particles, hydrotalcite, and the like are preferred. Further, the material obtained by hydrophobizing these inorganic particles can also be used as necessary.

Specific examples of the silica particles include commercially available products of R-805, R-976, R-974, R-972, R-812, and R-809, manufactured by NIPPON AEROSIL CO., LTD., HVK-2150, and H-200 manufactured by Hoechst AG, and commercially available products of TS-720, TS-530, TS-610, H-5, and MS-5 manufactured by Cabot Corporation.

Examples of the titania particles include commercially available products of T-805, and T-604 manufactured by NIPPON AEROSIL CO., LTD., commercially available products of MT-100S, MT-100B, MT-500BS, MT-600, MT-600SS, and JA-1 manufactured by Tayca Corporation, commercially available products of TA-300SI, TA-500, TAF-130, TAF-510, and TAF-510T manufactured by Fuji Titanium Industry Co., Ltd., and commercially available products of IT-S, IT-OA, IT-OB, and IT-OC manufactured by Idemitsu Kosan Co., Ltd.

Examples of the alumina particles include RFY-C, and C-604 manufactured by NIPPON AEROSIL CO., LTD., and a commercially available product of TTO-55 manufactured by ISHIHARA SANGYO KAISHA, LTD.

In addition, in order to further improve the cleanability and the transferability, a lubricant can be used. For example, higher fatty acid metal salts as described below can be used as a lubricant. That is, examples of the higher fatty acid metal salts include a salt of zinc, aluminum, copper, magnesium, calcium or the like of stearic acid; a salt of zinc, manganese, iron, copper, magnesium or the like of oleic acid; a salt of zinc, copper, magnesium, calcium or the like of palmitic acid; a salt of zinc, calcium or the like of linolic acid; and a salt of zinc, calcium or the like of recinoleic acid.

The additive amount of the external additives (the total amount in the case where two or more kinds are used) is preferably 0.1 to 10.0% by mass relative to the toner base particles.

[Dielectric Loss Tangent Tan δ and Relative Dielectric Constant ∈' of Toner]

The toner for electrostatic charge image development of the present invention satisfies the following Formula (1), when a maximum value and a minimum value of a dielectric loss tangent tan δ, which are obtained by measuring at a frequency in the range of 1 kHz to 100 kHz under the condition at a temperature of 20° C. and a relative humidity of 50% RH, are defined as tan $\delta_{max}$ and tan $\delta_{min}$, respectively. Further, the dielectric loss tangent tan δ can be measured by a method described in Examples.

$$\text{Frequency showing tan } \delta_{max} < \text{Frequency showing tan } \delta_{min} \quad (1)$$

FIGURE is a graph showing the relationship between the frequency and the value of tan δ of each toner in Examples 1 and 3, and Comparative Example 1 described later. Each toner in Examples 1 and 3, which satisfies the above formula (1) has so to speak a downward-sloping (decreasing) relationship between the frequency and the tan δ as shown in FIGURE. With the toner as described above, the rising of the toner charge amount is improved, and a high quality image having less density unevenness can be formed even during the image forming at a high speed and a high printing rate.

As long as satisfying the above formula (1), the toner may have a simple downward-sloping (decreasing) relationship as in Example 1 in FIGURE in the relationship between the frequency of from 1 kHz to 100 kHz and the tan δ, or may have a relationship having a local maximum value of tan δ between the frequencies of from 1 kHz to 100 kHz as in Example 3 in FIGURE. On the other hand, the toner having so to speak a upward-sloping (rising) relationship as in Comparative Example 1 in FIGURE does not satisfy the above formula (1), as a result of which the rising of the toner charge amount is deteriorated, and the toner generates the density unevenness during the image forming at a high speed and a high printing rate.

The toner of the present invention satisfying the above formula (1) can be obtained for example, by adjusting the amount of an aggregation stopping agent that is used at the time of producing a toner by an emulsion aggregation method, and by controlling the amount of a group 1 element (specifically, an alkali metal element such as Li, Na, and Mg) contained in a toner.

According to a preferred embodiment of the present invention, the dielectric loss tangent tan $\delta_{100\ kHz}$ of a toner measured at a frequency of 100 kHz is preferably 0.040 or less, and more preferably satisfies the following formula (2). In such a range, the electric charge is hardly leaked, and the toner chargeability is further improved.

$$\tan \delta_{100\ kHz} \leq 0.035 \quad (2)$$

The dielectric loss tangent tan $\delta_{100\ kHz}$ is furthermore preferably 0.030 or less, and particularly preferably 0.025 or less. Further, the lower limit value of tan $\delta_{100\ kHz}$ is usually zero.

In addition, in the toner of the present invention, the relative dielectric constant ∈' at a frequency of 100 kHz is preferably 1.8 or more, more preferably 2.0 or more, and furthermore preferably 2.5 or more. In the toner having the characteristics described above, the chargeability is further improved. Further, as the relative dielectric constant ∈' at a frequency of 100 kHz, a value of the relative dielectric constant ∈' at a frequency of 100 kHz, which is measured in the similar manner as in the tan δ, is employed.

The toner satisfying the above formula (2) can be obtained by adjusting the kind and the additive amount of a colorant, the additive amount of a crystalline resin in a binder resin, or the like. In general, when carbon black is used, or when the additive amount of a crystalline resin is increased, the conductivity of a toner becomes higher, and the value of tan δ tends to be increased. In addition, the relative dielectric constant ∈' at a frequency of 100 kHz can be controlled by adjusting the additive amount or the like of a crystalline resin. As described above, when the additive amount of a crystalline resin is increased, the conductivity of toner becomes higher, and the relative dielectric constant ∈' tends to be decreased.

[Net Intensity]

As described above, the toner of the present invention can be produced by controlling the amount of a group 1 element (specifically, an alkali metal element such as Li, Na, and Mg) contained in a toner by adjusting the amount of an aggregation stopping agent or the like that is used at the time of producing a toner using an emulsion aggregation method. In the toner of the present invention described above, the Net intensity of a group 1 element (specifically, an alkali metal element such as Li, Na, and Mg) by fluorescent X-ray analysis (hereinafter also simply referred to as "Net intensity") is preferably 0.50 or more, and more preferably 0.70 or more. In the range described above, the toner of the present invention, which satisfies the above formula (1) can be more easily obtained. The upper limit of the Net intensity is not particularly limited, but preferably 3.0 or less. When the upper limit of the Net intensity is in this range, favorable chargeability can be obtained even under the conditions of high temperature and high humidity (HH).

Further, the Net intensity is a value measured by using a fluorescent X-ray analyzer, and more specifically, the value can be measured by a method described in Examples.

[CV Value]

In the present invention, the coefficient of variation in a volume-based particle size distribution of toner base particles (CV value, hereinafter also simply referred to as "CV value") is preferably 16 to 19%. The CV value is a value expressed on a volume basis the dispersity in a particle size distribution of toner base particles, and expressed by the following formula (4). It is indicated that as the CV value is smaller, the particle size distribution becomes sharper, and the size of the toner base particles becomes uniform.

$$\text{Coefficient of variation(CV value)(\%)}=[(\text{Standard deviation in volume-based particle size distribution})/(\text{Median diameter}(D_{50})\text{ on a volume basis})]\times 100 \quad (4)$$

When the CV value is in the range described above, the image quality and the cleanability can be ensured. This CV value can be controlled, for example, by adjusting the amount of the aggregation stopping agent used at the time of producing a toner. Further, the volume-based median diameter and the CV value of the toner base particles can be measured by using "Coulter Multisizer 3" (manufactured by Beckman Coulter, Inc.).

(Production Method of Toner for Electrostatic Charge Image Development)

Next, the production method of the toner of the present invention will be described. The production method of the toner base particles of the present invention is not particularly limited, and a known method such as a kneading and pulverizing method, a suspension polymerization method, an emulsion aggregation method, a dissolution suspension method, a polyester elongation method, and a dispersion polymerization method can be mentioned.

Among them, an emulsion aggregation method is preferred. By employing an emulsion aggregation method, there is an advantage that particle diameter of the toner base particles can be reduced, and the toner particles having a sharp particle size distribution can be obtained by suppressing the generation of fine powder components. Further, there is also an advantage that the energy required for the production is less.

In the toner production by an emulsion aggregation method, multiple kinds of particles (a colorant, a binder resin, a releasing agent, and the like), in which a particle surface property, that is, aggregation stability is different from each other, are used to grow the particle diameter.

The emulsion aggregation method is a method in which a dispersion liquid of binder resin particles containing a binder resin that is produced by an emulsion polymerization or the like (a crystalline resin particle dispersion liquid and/or an amorphous resin particle dispersion liquid), and a dispersion liquid of components forming toner base particles such as colorant particles are mixed under a water-based environment, the resultant mixture is aggregated by adding an aggregating agent, and an aggregation stopping agent is added as necessary to control the particle diameter, further the shape is controlled by the fusion among binder resin particles, and the toner base particles are produced.

In the emulsion aggregation method, as described above, firstly, particles of a binder resin are formed by a conventionally known emulsion polymerization or the like, and the resin particles are aggregated and fused to form toner base particles. More specifically, the monomers constituting a binder resin are put into an aqueous medium and dispersed, and these polymerizable monomers are polymerized by a polymerization initiator, and a dispersion liquid of binder resin particles is prepared.

As the method for obtaining a crystalline resin particle dispersion liquid, in addition to the above-described method in which polymerizable monomers are polymerized by a polymerization initiator in an aqueous medium, for example, a method in which a dispersion treatment is performed in an aqueous medium without using a solvent; a method in which a crystalline resin is dissolved in a solvent such as ethyl acetate to prepare a solution, the solution is emulsified and dispersed in an aqueous medium by using a disperser, and then the resultant mixture is subjected to a desolvation treatment; or the like can be mentioned.

At this time, as necessary, a releasing agent may be preliminarily contained in a binder resin (a crystalline resin and/or an amorphous resin). In addition, for the dispersion, it is also preferred that the polymerization is performed in the presence of an appropriately known surfactant (for example, an anionic surfactant such as sodium polyoxyethylene(2)dodecyl ether sulfate, and sodium dodecyl sulfate).

The particle diameter (volume-based median diameter) of the binder resin particles is preferably 100 to 300 nm. In addition, it is preferred that by performing the polymerization of monomers in multiple stages, for example, the amorphous resin is made in a form of multiple layers constituting two or more layers that includes resins having a composition different from each other (or resins having the same composition as each other). By having the form of multiple layers as described above, a toner having sharper particle size distribution can be obtained at the time of producing the toner by an emulsion aggregation method.

In addition, separately, colorant particles are dispersed in an aqueous medium to prepare a colorant particle dispersion liquid. The particle diameter (volume-based median diameter) of the colorant particles in dispersion liquid is preferably 80 to 200 nm.

Next, the above-described binder resin particles and colorant particles are aggregated in an aqueous medium, and these particles are fused to prepare toner base particles. That is, into the aqueous medium in which a binder resin particle dispersion liquid and a colorant particle dispersion liquid have been mixed, an alkali metal salt, a group 2 metal salt containing an alkaline earth metal, or the like is added as an aggregating agent, and then the aggregation is allowed to proceed by heating at a temperature higher than the glass transition temperature of binder resin particles, and resin particles are fused to each other. Further, when the size of the toner base particles reaches the intended size, a salt (mainly, an alkali metal salt) is added to terminate the aggregation. After that, by heat-treating the reaction system, the toner base particles are aged until the shape of the particles reaches the desired shape, and thus the toner base particles are completed.

In addition, after the temperature of the dispersion liquid for aggregation reaches a temperature of the glass transition temperature of the binder resin or higher, while maintaining the temperature of the dispersion liquid for a certain period of time, the fusion is continued. As a result, the growth of toner base particles (aggregation of binder resin particles and colorant particles), and fusion (disappearance of the interfaces among particles) are effectively allowed to proceed.

The use amount of the aggregating agent is preferably 5 to 20% by mass relative to the total amount of solid content of binder resin particles and colorant particles. After that, the mixture is left to stand for 1 to 6 minutes, and the temperature is raised to 70 to 95° C. over 30 to 90 minutes, consequently, the aggregated binder resin particles and colorant particles can be fused. At this time, the volume-based median diameter of the fused toner base particles is measured, and when the volume-based median diameter reaches 4.5 to 10 μm, an aqueous solution or the like of the aggregation stopping agent is added to terminate the growth of particles.

Further, as an aging treatment, the aggregation liquid temperature is kept to 70 to 90° C., and heating and stirring are performed for 0.5 to 6 hours, and the fusion among particles is preferably proceeded until the average circularity reaches usually 0.91 or more, and preferably 0.920 to 0.995.

The volume-based median diameter can be measured by using, for example, "Coulter Multisizer 3" manufactured by Beckman Coulter, Inc. The average circularity can be measured by a method used in Examples described later. In addition, in the aging process, by applying shearing to the toner particles with heating and stirring, the resin particles in aggregate particles are fused to each other, and further, the average circularity and the surface property of the particles can be controlled.

<Aqueous Medium>

In the present invention, the term "aqueous medium" means a medium containing at least 50% by mass or more of water, and as a component other than the water, an organic solvent that dissolves in water can be mentioned. Examples of the organic solvent include methanol, ethanol, isopropanol, butanol, acetone, methyl ethyl ketone, dimethyl formamide, methyl cellosolve, and tetrahydrofuran.

<Aggregating Agent>

The aggregating agent to be used in the aggregate particle forming process is not particularly limited, but as the aggregating agent for growing particles by charge neutralization reaction and crosslinking action, an aggregating agent selected from metal salts is suitable. Examples of the metal salts include a monovalent metal salt such as an alkali metal salt of sodium, potassium, lithium, or the like; a divalent metal salt of calcium, magnesium, manganese, copper, or the like; and a trivalent metal salt of iron, aluminum, or the like. Specific examples of the metal salt include sodium chloride, potassium chloride, lithium chloride, calcium chloride, magnesium chloride, zinc chloride, copper sulfate, magnesium sulfate, manganese sulfate, aluminum sulfate, polyaluminum chloride, and zinc acetate. Among them, because the aggregation can be allowed to proceed by a smaller amount, a divalent metal salt is particularly preferably used. These can be used singly alone or in combination of two or more kinds thereof.

<Aggregation Stopping Agent>

As the aggregation stopping agent for terminating the growth of aggregate particles, a compound or a salt which reduces the aggregation action can be used. For example, sodium chloride, polyvalent organic acid or a salt thereof, amino acid or a salt thereof, or polyphosphonic acid or a salt thereof can be used. Further, a method for reducing the aggregation action by changing the pH in a system can be used. In order to adjust the pH, an aqueous sodium fumarate solution, an aqueous sodium hydroxide solution, hydrochloric acid, or the like can be used. In addition, by adjusting the pH, and further using a chelating agent in combination, the crosslinking action by metal ions is reduced, and this is also effective. Examples of the chelating agent include HIDA (hydroxyethyl iminodiacetic acid), HEDTA (hydroxyethyl ethylenediamine triacetic acid), HEDP (hydroxyethylidene diphosphonic acid), and HIDS (3-hydroxy-2,2'-iminodisuccinic acid). Further, as the aggregation stopping agent, a compound different from the above-described aggregating agent is used.

As described above, the tan δ of the toner of the present invention can be controlled by the additive amount of the aggregation stopping agent. For example, in the case where sodium chloride is used as an aggregation stopping agent, the additive amount per gram of the aggregation liquid (latex) is preferably 1 to 10 mmol/g-latex, more preferably 2 to 8 mmol/g-latex, and particularly preferably 2 to 5 mmol/g-latex.

From the above, according to one embodiment of the production method of a toner for electrostatic charge image development, the following processes are included.

(1) A colorant particle dispersion liquid preparation process for preparing a dispersion liquid in which colorant particles are dispersed in an aqueous medium;

(2) a binder resin particle dispersion liquid preparation process for preparing a dispersion liquid in which binder resin particles (crystalline resin particles and/or amorphous resin particles) containing an internal additive such as a releasing agent and a charge control agent as necessary are dispersed in an aqueous medium;

(3) an aggregation and fusion process for growing aggregate particles by aggregating and fusing binder resin particles and colorant particles, and other particles of toner constituent components as necessary in an aqueous medium;

(4) an aggregation stopping agent addition process for terminating growth of aggregate particles by terminating the aggregation with the addition of a specific aggregation stopping agent in an aqueous medium; and (5) an aging process for obtaining toner base particles by aging aggregate particles with heat energy, and controlling the shape are included.

Further, according to one preferred embodiment of the production method of a toner for electrostatic charge image development, the following processes are further included.

(6) A filtration and washing process for removing an aggregating agent, an aggregation stopping agent, a surfactant, and the like from the toner base particles by filtering out the toner base particles from an aqueous medium;

(7) a drying process for drying the wash-treated toner base particles; and subsequently, (8) an external additive addition process for adding an external additive to the dry-treated toner base particles, are included, and through the above-described processes, a toner for electrostatic charge image development can be prepared.

[Developer]

As to the use of the toner of the present invention toner, a case of using the toner as a single component magnetic toner, for example, by containing a magnetic material, a case of using the toner as a two-component developer by mixing so-called a carrier, a case of using a non-magnetic toner alone, or the like can be mentioned, and any one of the above cases can be suitably used.

As the carrier forming a two-component developer, magnetic particles including a conventionally known material such as a metal such as iron, ferrite, and magnetite; or an alloy thereof with a metal such as aluminum, and lead can be used, and particularly ferrite particles are preferably used.

As the carrier, the volume average particle diameter is preferably 15 to 100 μm, and more preferably 25 to 60 μm.

As the carrier, a carrier further coated with a resin, or a so-called resin dispersion type carrier in which magnetic particles are dispersed in a resin, is preferably used. The resin composition for coating is not particularly limited, but, for example, an olefin resin, a cyclohexyl methacrylate-methylmethacrylate copolymer, a styrene resin, a styrene-acrylic resin, a silicone resin, an ester resin, a fluorine resin, or the like is used. In addition, the resin for forming a resin dispersion type carrier is not particularly limited, and a known resin can be used, for example, an acrylic resin, a styrene-acrylic resin, a polyester resin, a fluorine resin, a phenol resin, or the like can be used.

[Image Forming Method]

The toner of the present invention is not particularly limited, but an image forming method including the following processes can be suitably used:

(1) an electrostatic charge image formation process for forming an electrostatic charge image on an image carrier by electrifying and exposing a surface of the image carrier;

(2) a development process for forming a toner image by developing the electrostatic charge image formed on the image carrier with a developer containing a toner;

(3) a transfer process for transferring the toner image formed on the image carrier onto a recording medium; and (4) a fixing process for fixing the toner image transferred on the recording medium with a heat roller system.

In the above-described image forming method, usually, multiple chromatic color toners and achromatic color toners are used, but preferably at least one kind among the multiple chromatic color toners is the toner of the present invention, more preferably all of the multiple chromatic color toners are the toners of the present invention, and furthermore preferably all of the multiple chromatic color toners and the achromatic color toners are the toners of the present invention.

According to the image forming method of the present invention, by using the toner satisfying the above formula (1), the rising of the toner charge amount is improved while ensuring the low temperature fixability, and a high quality image having less density unevenness can be obtained even during the image forming at a high speed and a high printing rate.

[Image Forming Apparatus]

As the image forming apparatus to which the image forming method of the present invention is applied, for example, a cycle-type apparatus in which the apparatus has one image carrier, and multiple developing devices that are filled with developers of respective colors and arranged around the image carrier, toner images for the respective colors are formed on the image carrier, the respective toner images are sequentially transferred on an intermediate transfer member or the like and superimposed, the toner images are collectively transferred on a recording medium and fixed by a heat roller system, and a visible image (fixed image) is formed can be mentioned.

In addition, As another example of the image forming apparatus to which the image forming method of the present invention is applied, for example, a drum tandem-type apparatus in which an image forming unit having a developing device and an image carrier for each color is installed respectively for each color, toner images are formed on the respective image carriers, the toner images are sequentially transferred on an intermediate transfer member and superimposed, the toner images are collectively transferred on a recording medium and fixed by a heat roller system, and a visible image (fixed image) is formed can be mentioned.

EXAMPLES

Hereinafter, the representative embodiments of the present invention will be shown, and the present invention will be further described. Of course, the present invention is not limited to these embodiments. In addition, in Examples, unless otherwise specifically noted, the expression of "parts" represents "parts by mass", and the expression of "%" represents "% by mass".

[Preparation of Toner]

Example 1

[Preparation of Dispersion Liquid [MD1] of Amorphous Resin (Vinyl Resin) Particles [M1] Containing Releasing Agent]

(First Stage Polymerization)

Into a 5-liter volume reaction vessel equipped with a stirring device, a temperature sensor, a condenser, and a nitrogen introduction device, a solution in which 8 g of sodium dodecyl sulfate had been dissolved in 3 L of ion-exchange water was charged, and the internal temperature was raised to 80° C. while stirring at a stirring speed of 230 rpm under a nitrogen stream. After that, into the resultant mixture, a solution in which 10 g of potassium persulfate had been dissolved in 200 g of ion-exchange water was added, the solution temperature was raised to 80° C. again, and then into the mixture, a monomer mixture including 480 g of styrene, 250 g of n-butyl acrylate, and 68 g of methacrylic acid was added dropwise over 1 hour. After that, the resultant mixture was heated and stirred at 80° C. for 2 hours for the polymerization, and a resin particle dispersion liquid [A1] in which resin particles [a1] had been dispersed was prepared.

(Second Stage Polymerization)

Into a 5-liter volume reaction vessel equipped with a stirring device, a temperature sensor, a condenser, and a nitrogen introduction device, a solution in which 6 g of sodium polyoxyethylene(2) dodecyl ether sulfate had been dissolved in 1850 ml of ion-exchange water was charged, the resultant mixture was heated to 80° C., and then 260 g of the above-described resin particle dispersion liquid [A1] was added.

Further, a monomer solution in which 175 g of styrene, 80 g of n-butyl acrylate, 3.8 g of n-octyl-3-mercaptopropionate, and 86.5 g of behenyl behenate (melting point of 73° C.) as a releasing agent had been dissolved and mixed at 80° C. was mixed and dispersed for 15 minutes by a mechanical dispersing machine having a circulation pass, "CLEARMIX (registered trademark)" (manufactured by M Technique Co., Ltd.), and a dispersion liquid containing emulsified particles (oil droplets) was prepared.

Next, in the reaction vessel, an initiator solution in which 5 g of potassium persulfate had been dissolved in 100 ml of ion-exchange water was added, the system was heated and stirred at 82° C. over one hour for the polymerization, and a resin particle dispersion liquid [A2] in which resin particles [a2] had been dispersed was prepared.

(Third Stage Polymerization)

Into the above-described resin particle dispersion liquid [A2], a solution in which 5 g of potassium persulfate had been dissolved in 100 ml of ion-exchange water was added, and into the resultant mixture, under the temperature condition of 82° C., a monomer mixture including 303.5 g of styrene, 118.5 g of n-butyl acrylate, 70 g of methacrylic acid, and 8 g of n-octyl-3-mercaptopropionate was added dropwise over 90 minutes. After the completion of the dropwise addition, the resultant mixture was heated and stirred over two hours for the polymerization, and then cooled down to 28° C., consequently, a dispersion liquid

[MD1] of the amorphous resin particles [M1] containing a vinyl monomer as a main component and a releasing agent was prepared.

As to the dispersion liquid [MD1], when the volume-based median diameter of the amorphous resin particles [M1] was measured, the volume-based median diameter was 220 nm. Further, when the molecular weight of the amorphous resin forming the amorphous resin particles [M1] was measured, the weight average molecular weight was 30,200.

[Preparation of Water-Based Dispersion Liquid [C1] of Hybrid Crystalline Polyester Resin Particles]

Synthesis of a Hybrid Crystalline Polyester Resin (c1)

The following raw material monomers (monomers) of an addition polymerization resin, a bireactive monomer (monomer), and a radical polymerization initiator were put into a dropping funnel.

35 Parts by mass of styrene, 9 parts by mass of n-butyl acrylate, 4 parts by mass of acrylic acid, 7 parts by mass of a polymerization initiator (di-t-butyl peroxide), and further, the following polycondensation raw material monomers were put into a four-neck flask equipped with a nitrogen inlet tube, a dehydration tube, a stirrer, and a thermocouple, and the resultant mixture was heated to 170° C. and dissolved.

318 Parts by mass of dodecanedioic acid, 196 parts by mass of 1,6-hexanediol, then, raw material monomers of an addition polymerization resin were added dropwise over 90 minutes, and aged for 60 minutes, and then unreacted addition polymerization monomers were removed under reduced pressure (8 kPa). After that, 0.8 parts by mass of $Ti(O\text{-}n\text{-}Bu)_4$ was charged as an esterification catalyst, the temperature was raised up to 235° C., and the resultant mixture was reacted for 5 hours under normal pressure (101.3 kPa) and further reacted for one hour under reduced pressure (8 kPa). Next, the mixture was cooled down to 200° C., and reacted for one hour under reduced pressure (20 kPa) to obtain a hybrid crystalline polyester resin (c1). The weight average molecular weight (Mw) of the obtained hybrid crystalline polyester resin (c1) was 6,800, and the melting point was 77° C.

30 Parts by mass of the hybrid crystalline polyester resin (c1) was transferred while keeping the molten state to an emulsifying and dispersing machine, "Cavitron CD1010" (manufactured by EUROTEC, Ltd.) at a transfer rate of 100 parts by mass per minute. In addition, at the same time as the transfer of the hybrid crystalline polyester resin (c1) in a molten state, into the emulsifying and dispersing machine, dilute ammonia water with a concentration of 0.37% by mass, which was obtained by diluting 70 parts by mass of reagent ammonia water with ion-exchange water in an aqueous solvent tank, was transferred at a transfer rate of 0.1 liter per minute while heating at 100° C. by a heat exchanger. Further, by driving the emulsifying and dispersing machine under the conditions at a rotational speed of a rotor of 60 Hz and a pressure of 5 $kg/cm^2$, a water-based dispersion liquid [C1] of hybrid crystalline polyester resin particles (crystalline resin particle dispersion liquid [C1]) having a volume-based median diameter of 200 nm and a solid content of 30% by mass was prepared.

[Preparation of Colorant Particle Dispersion Liquid [Cy]]

11.5 Parts by mass of sodium dodecyl sulfate was stirred and dissolved in 160 parts by mass of ion-exchange water, and into the resultant mixture, 25 parts by mass of C.I. Pigment Blue 15:3 that is a colorant was gradually added. This dispersion liquid was subjected to a dispersion treatment by using CLEARMIX (registered trademark) W-Motion CLM-0.8 (manufactured by M Technique Co., Ltd.), and a colorant particle dispersion liquid [Cy] was prepared. The volume-based median diameter of the colorant particles in the colorant particle dispersion liquid [Cy] was 150 nm as measured by using "MICROTRAC UPA 50" (manufactured by Honeywell Inc.) under the following conditions.

[Measurement Conditions]

Sample refractive index: 1.59

Sample specific gravity: 1.05 (in terms of spherical particles)

Solvent refractive index: 1.33

Solvent viscosity: 0.797 mPa·s at 30° C., and 1.002 mPa·s at 20° C.

Ion-exchange water was put into a measurement cell, and zero point adjustment was performed.

Production Example 1 of Toner

Into a flask equipped with a stirring device, a temperature sensor, a condenser, and a nitrogen introduction device, 400 parts by mass of ion-exchange water, 522 parts by mass (in terms of solid content) of a dispersion liquid [MD1] of amorphous resin particles [M1] containing a releasing agent, 36 parts by mass (in terms of solid content) of a colorant particle dispersion liquid [Cy], and 42 parts by mass (in terms of solid content) of a crystalline resin particle dispersion liquid [C1], were charged, the solution temperature was adjusted to 25° C., and then into the resultant mixture, an aqueous sodium hydroxide solution having a concentration of 25% by mass was added to adjust the pH to 10.5.

Next, into the mixture, an aqueous solution in which 50 parts by mass of magnesium chloride.hexahydrate had been dissolved in 50 parts by mass of ion-exchange water was added, and by raising the temperature of the system up to 80° C., the aggregation reaction of respective resin particles and colorant particles was started. In addition, in the present invention, the addition order of the dispersion liquid [MD1], the colorant particle dispersion liquid [Cy], the crystalline resin particle dispersion liquid [C1], and magnesium chloride was not particularly limited. Hereinafter, the same applies.

After starting the aggregation reaction, the reaction mixture was periodically sampled, the volume-based median diameter of particles was measured by using a particle size distribution measuring device, "Coulter Multisizer 3" (manufactured by Beckman Coulter, Inc.), and the aggregation was performed while continuing the stirring until the volume-based median diameter reached 6.0 μm.

After that, into the mixture, an aqueous solution in which 253.6 parts by mass of sodium chloride had been dissolved in 1014.5 parts by mass of ion-exchange water (an aqueous solution of an aggregation stopping agent) was added, and the temperature of the system was set at 82° C., and the stirring was continued for 4 hours. When the average circularity reached 0.960 as measured by using a flow type particle image analyzer, "FPIA-2100" (manufactured by Sysmex Corporation), the mixture was cooled down to 30° C. at a cooling rate of 6° C. per minute to terminate the reaction, consequently, a dispersion liquid of toner base particles was obtained. As a result of the measurement by using a particle size distribution measuring device, "Coulter Multisizer 3" (manufactured by Beckman Coulter, Inc.), the particle diameter (volume-based median diameter) and the CV value of the toner base particles after the cooling were 6.1 μm and 17%, respectively. Further, the average circularity was 0.960. In addition, in other Examples and Comparative Examples, each particle diameter and each average circularity were both the same as those in Example 1.

The dispersion liquid of toner base particles thus obtained was subjected to solid-liquid separation by using a basket-type centrifuge, "MARK III, model number: 60×40" (manufactured by MATSUMOTO MACHINE SALES Co., Ltd.), and a wet cake was formed. The wet cake was repeatedly subjected to the washing and the solid-liquid separation by using the above-described basket-type centrifuge until the electric conductivity of the filtrate reached 15 μS/cm. After that, by blowing an air flow at a temperature of 40° C. and at a relative humidity of 20% RH with the use of "Flash jet dryer" (manufactured by SEISHIN ENTERPRISE Co., Ltd.), the resultant wet cake was dry-treated until the water content reached 0.5 mass %, and cooled down to 24° C. to obtain toner base particles [1X].

Into the obtained toner base particles [1X], 1% by mass of hydrophobic silica particles (number average secondary particle diameter: 30 μm, and number average primary particle diameter: 50 to 200 nm), and 1.2% by mass of hydrophobic titanium oxide particles (number average secondary particle diameter: 20 μm, and number average primary particle diameter: 50 to 200 nm) were added, and mixed over 20 minutes by using a Henschel Mixer under the condition at a peripheral speed of a rotor blade of 24 m/s, and further into the resultant mixture, an external additive was added by passing through a 400 mesh sieve, consequently, a toner [1] was obtained.

Example 2

A toner [2] was prepared in the similar manner as in Example 1 except that C.I. Pigment Red 122 was used in place of the C.I. Pigment Blue 15:3 as a colorant.

Example 3

A toner [3] was prepared in the similar manner as in Example 1 except that C.I. Pigment Yellow 74 was used in place of the C.I. Pigment Blue 15:3 as a colorant.

Example 4

A toner [4] was prepared in the similar manner as in Example 1 except that an aqueous solution in which 164.7 parts by mass of sodium chloride had been dissolved in 658.8 parts by mass of ion-exchange water was used as an aqueous solution of an aggregation stopping agent.

Example 5

A toner [5] was prepared in the similar manner as in Example 1 except that an aqueous solution in which 115.3 parts by mass of sodium chloride had been dissolved in 461.1 parts by mass of ion-exchange water was used as an aqueous solution of an aggregation stopping agent.

Example 6

A toner [6] was prepared in the similar manner as in Example 1 except that the amount of the dispersion liquid [MD1] was set to 558 parts by mass (in terms of solid content) and the amount of the dispersion liquid [C1] was set to 6 parts by mass (in terms of solid content) in [Production Example 1 of toner].

Example 7

A toner [7] was prepared in the similar manner as in Example 1 except that the amount of the dispersion liquid [MD1] was set to 510 parts by mass (in terms of solid content) and the amount of the dispersion liquid [C1] was set to 54 parts by mass (in terms of solid content) in [Production Example 1 of toner].

Example 8

A toner [8] was prepared in the similar manner as in Example 1 except that the amount of the dispersion liquid [MD1] was set to 498 parts by mass (in terms of solid content) and the amount of the dispersion liquid [C1] was set to 66 parts by mass (in terms of solid content) in [Production Example 1 of toner].

Example 9

[Preparation of Colorant Particle Dispersion Liquid [Bk]]

90 g of sodium dodecyl sulfate was stirred and dissolved in 1600 g of ion-exchange water, and into the resultant solution, 420 g of carbon black (furnace black), "REGAL (registered trademark) 330R" (manufactured by Cabot Corporation) was gradually added while stirring the solution. Next, the resultant mixture was subjected to a dispersion treatment by using a stirring device, "CLEARMIX (registered trademark)" (manufactured by M Technique Co., Ltd.), and a colorant particle dispersion liquid [Bk] in which colorant particles [Bk] had been dispersed was prepared. The volume-based median diameter of the colorant particles [Bk] in the colorant particle dispersion liquid [Bk] was 120 nm as measured by using an electrophoretic light scattering spectrophotometer, "ELS-800" (manufactured by Otsuka Electronics Co., Ltd.).

A toner [9] was prepared in the similar manner as in Example 1 except that 54 parts by mass (in terms of solid content) of the above-described colorant particle dispersion liquid [Bk] was used in place of the colorant particle dispersion liquid [Cy], further the amount of the dispersion liquid [MD1] was set to 504 parts by mass (in terms of solid content), and an aqueous solution in which 245.5 parts by mass of sodium chloride had been dissolved in 982.1 parts by mass of ion-exchange water was used as an aqueous solution of an aggregation stopping agent.

Example 10

A toner [10] was prepared in the similar manner as in Example 9 except that the amount of the dispersion liquid [MD1] was set to 492 parts by mass (in terms of solid content) and the amount of the dispersion liquid [C1] was set to 54 parts by mass (in terms of solid content).

Comparative Example 1

A toner [11] was prepared in the similar manner as in Example 1 except that an aqueous solution in which 245.5 parts by mass of sodium chloride had been dissolved in 368.9 parts by mass of ion-exchange water was used as an aqueous solution of an aggregation stopping agent.

Comparative Example 2

A toner [12] was prepared in the similar manner as in Comparative Example 1 except that C.I. Pigment Red 122 was used in place of the C.I. Pigment Blue 15:3 as a colorant.

[Performance Evaluation]

<Dielectric Loss Tangent (Tan δ), and ∈'>

As a measurement sample, a disk-shaped sample with 40 mmϕ (thickness: around 2 mm), which had been molded by applying a load of 100 kgf/cm$^2$ to 2 g of a toner over 10 seconds, was used. Further, the thickness of the disk-shaped sample was measured with a vernier caliper. The dielectric loss tangent tan δ was measured by using a LCR meter 65120P (manufactured by TOYO Corporation) under the condition at a temperature of 20° C. and a relative humidity of 50% RH. By using WITNESS-6000 that is supplied software, by setting the number of points of one digit to 5 and the number of averages to 3, respectively, from 1 kHz to 100 kHz of the measurement frequency, and by inputting the thickness of the disk-shaped sample, the measurement of the dielectric loss tangent tan δ was performed. In addition, the ∈' was measured at a frequency of 100 kHz.

<Net Intensity of Sodium Element>

By using a fluorescent X-ray analyzer, "XRF-1700" (manufactured by Shimadzu Corporation), the Net intensity of the metal amount (alkali metal amount) was measured. As the specific measurement method of the Net intensity, 2 g of a toner was pelletized by pressing for 10 seconds under a load of 15 t, the measurement was performed by qualitative and quantitative analysis (see the following measurement conditions). Further, in the measurement, the Kα peak angle of an alkali metal element (specifically, a sodium element) to be measured was determined from a 2θ table and used.

—Measurement Conditions—

Slit: normal

Attenuator: none

Dispersive crystal (Na=TAP)

Detector (Na=FPC)

<Charge Amount (One Minute)>

9.25 g of a carrier and 0.75 g of a toner were weighed in a 20 cc sample bottle, and conditioned at 25° C. and 50% RH overnight. After that, the resultant mixture was shaken for one minute with 200 strokes in a shaking machine, and a two-component developer was obtained. 0.05 g of the obtained two-component developer was placed between parallel plate (aluminum) electrodes with sliding, the charge amount and the mass of the toner were measured when the toner was developed under the conditions that the gap between the electrodes was 0.5 mm, the DC bias was 1.0 kV, the AC bias was 4.0 kV, and the frequency was 2.0 kHz, and the charge amount Q/m (μC/g) per unit mass was employed as the charge amount. The present evaluation was performed for evaluating the rising of the toner charge amount, and 45 μC/g or more was accepted.

In addition, as the carrier, a ferrite carrier having volume average particle diameter of 60 μm to which a silicone resin had been coated was used.

<Density Unevenness>

A commercially available combined printer, "bizhub PRO (registered trademark) C500" (manufactured by KONICAMINOLTA, INC.) was remodeled and used for the output on a sheet of CF paper manufactured by KONICA MINOLTA, INC. under the condition at a temperature of 20° C. and a relative humidity of 50% RH. By adjusting the developing bias, the toner adhesion amount on the paper sheet was adjusted to 4.5 g/m$^2$, and the image density was measured at 5 points. When the density difference between the maximum value and the minimum value of the image density was 0.1 or less, the density unevenness was classified as ⊙, when the density difference was exceeding 0.1 to less than 0.3, the density unevenness was classified as ○, when the density difference was 0.3 or more, the density unevenness was classified as ×, and when the density difference was less than 0.3, the density unevenness was classified as acceptable.

In addition, the image density was measured by using a spectrophotometer, "Gretag Macbeth Spectrolino" (manufactured by Gretag Macbeth). By using a D65 light source as the light source and an aperture with 4 mmϕ as the reflection measurement aperture, the measurement was performed under the condition at 10 nm intervals in the measurement wavelength range of 380 to 730 nm, at a viewing angle of 2°, and of using a dedicated white tile for reference matching.

<Under Offset Temperature (Low Temperature Fixability)>

As an image forming apparatus, a commercially available full-color multifunction machine, "bizhub PRO (registered trademark) C6500" (manufactured by KONICA MINOLTA, INC.) was remodeled such that each surface temperature of a fixing upper belt and a fixing lower roller is variable, and used. A test in which on a sheet of a recording material "NPi high-quality paper 128 g/m$^2$" (manufactured by NIPPON PAPER INDUSTRIES CO., LTD.), a solid image with a toner adhesion amount of 11.3 g/m$^2$ was output at a fixing temperature of 200° C. and at a fixing speed of 300 mm/sec was performed. The test was repeatedly performed until the cold offset occurred while changing the fixing temperature to decrease in 5° C. increments. The lowest surface temperature of the fixing upper belt, at which the cold offset did not occur, was investigated, and by using the lowest surface temperature as the fixing lower limit temperature, the low temperature fixability was evaluated. In each test, the fixing temperature means the surface temperature of the fixing upper belt, and the surface temperature of the fixing lower roller was set to a temperature 20° C. lower than the temperature of the fixing upper belt at all times. It is indicated that as the fixing lower limit temperature is lower, the low temperature fixability becomes excellent. In the present evaluation, the case where the temperature was 145° C. or lower was evaluated as acceptable.

The characteristics and evaluation results of the toners in Examples and Comparative Examples are shown in the following Table 1.

TABLE 1

| | Prescription | | | | Dielectric loss tangent | | | | | Performance evaluation | | |
|---|---|---|---|---|---|---|---|---|---|---|---|---|
| | Toner No. | Kind of colorant | Terinating salt amount (mmol/g-latex) | CPES amount (% by mass) | Frequency of $\tan\delta_{max}$ | Frequency of $\tan\delta_{min}$ | tan δ 100 kHz | ε' | Net intensity Na | Toner charge amount (1 min) (μC/g) | Density unevenness | Under offset temperature (° C.) |
| Example 1 | 1 | C.I. Pigment Blue 15:3 | 7.7 | 7 | 1 kHz | 100 kHz | 0.030 | 2.5 | 1.10 | 52 | ⊙ | 140 |

TABLE 1-continued

| | Prescription | | | | Dielectric loss tangent | | | | | Performance evaluation | | |
|---|---|---|---|---|---|---|---|---|---|---|---|---|
| | Toner No. | Kind of colorant | Terinating salt amount (mmol/g-latex) | CPES amount (% by mass) | Frequency of tanδ $_{max}$ | Frequency of tanδ $_{min}$ | tan δ 100 kHz | ε' | Net intensity Na | Toner charge amount (1 min) (μC/g) | Density unevenness | Under offset temperature (° C.) |
| Example 2 | 2 | C.I. Pigment Red 122 | 7.7 | 7 | 2.51 kHz | 100 kHz | 0.030 | 2.5 | 1.10 | 52 | ⊙ | 140 |
| Example 3 | 3 | C.I. Pigment Yellow 74 | 7.7 | 7 | 1.58 kHz | 100 kHz | 0.030 | 2.5 | 1.10 | 52 | ⊙ | 140 |
| Example 4 | 4 | C.I. Pigment Blue 15:3 | 5.0 | 7 | 1 kHz | 100 kHz | 0.030 | 2.5 | 0.70 | 51 | ⊙ | 140 |
| Example 5 | 5 | C.I. Pigment Blue 15:3 | 3.5 | 7 | 1 kHz | 100 kHz | 0.030 | 2.5 | 0.50 | 51 | ○ | 140 |
| Example 6 | 6 | C.I. Pigment Blue 15:3 | 7.7 | 1 | 1 kHz | 100 kHz | 0.025 | 2.8 | 1.10 | 53 | ⊙ | 145 |
| Example 7 | 7 | C.I. Pigment Blue 15:3 | 7.7 | 9 | 1 kHz | 100 kHz | 0.032 | 2.0 | 1.10 | 50 | ○ | 138 |
| Example 8 | 8 | C.I. Pigment Blue 15:3 | 7.7 | 11 | 1 kHz | 100 kHz | 0.035 | 1.8 | 1.10 | 49 | ○ | 136 |
| Example 9 | 9 | Carbon black | 7.7 | 7 | 1 kHz | 100 kHz | 0.035 | 2.5 | 1.10 | 48 | ○ | 140 |
| Example 10 | 10 | Carbon black | 7.7 | 9 | 1 kHz | 100 kHz | 0.038 | 2.3 | 1.10 | 45 | ○ | 138 |
| Comparative Example 1 | 11 | C.I. Pigment Blue 15:3 | 2.8 | 7 | 100 kHz | 1 kHz | 0.035 | 2.5 | 0.40 | 40 | X | 140 |
| Comparative Example 2 | 12 | C.I. Pigment Red 122 | 2.8 | 7 | 100 kHz | 6.31 kHz | 0.036 | 2.5 | 0.40 | 40 | X | 140 |

As is apparent from the above Table 1, in the toners in all of Examples, it can be understood that the rising of the toner charge amount is improved, the improvement of image quality can be realized, and the low temperature fixability is excellent.

On the other hand, in the toners in Comparative Examples 1 and 2, which do not satisfy the formula (1), it was suggested that the rising of the toner charge amount is deteriorated, and the image quality is lowered.

What is claimed is:

1. A toner for electrostatic charge image development, comprising:

a toner base particle comprising at least a binder resin, a releasing agent, and a colorant, wherein the toner satisfies the following formula (1), wherein a maximum value and a minimum value of a dielectric loss tangent tan δ of the toner, which are obtained by measuring at a frequency in the range of 1 kHz to 100 kHz under the condition at a temperature of 20° C. and a relative humidity of 50% RH, are defined as tan $\delta_{max}$ and tan $\delta_{min}$, respectively, $$\text{Frequency of tan } \delta_{max} < \text{Frequency of tan } \delta_{min} \quad (1),$$

the binder resin comprises a crystalline polyester resin, the toner base particle has a content of the crystalline polyester resin of 1 to 15% by mass, and the colorant is a chromatic colorant.

2. The toner for electrostatic charge image development according to claim 1, wherein the toner has a dielectric loss tangent tan $\delta_{100\ kHz}$ measured at a frequency of 100 kHz satisfies the following formula (2)

$$\tan \delta_{100\ kHz} \leq 0.035 \quad (2).$$

3. The toner for electrostatic charge image development according to claim 1, wherein the toner has a relative dielectric constant ε' at a frequency of 100 kHz is 2.0 or more.

4. The toner for electrostatic charge image development according to claim 1, wherein Net intensity of a group 1 element measured by fluorescent X-ray analysis is 0.70 or more.

5. The toner for electrostatic charge image development according to claim 1, wherein the binder resin comprises a vinyl resin.

6. An image forming method, comprising:

forming an electrostatic charge image on an image carrier by electrifying and exposing a surface of the image carrier;

forming a toner image by developing the electrostatic charge image formed on the image carrier with a developer comprising a toner;

transferring e toner image formed on the image carrier onto a recording medium; and fixing the toner image transferred on the recording medium with a heat roller system, wherein the toner is the toner for electrostatic charge image development set forth in claim 1.

7. The toner for electrostatic charge image development according to claim 1, wherein the Net intensity of a group 1 element measured by fluorescent X-ray analysis is 0.70 or more to 3.0 or less.

8. The toner for electrostatic charge image development according to claim 1, wherein the content of the crystalline polyester resin in the toner base particle is 7 to 12% by mass.

* * * * *